US006280307B1

(12) United States Patent
Lea

(10) Patent No.: US 6,280,307 B1
(45) Date of Patent: Aug. 28, 2001

(54) HAND-HELD TOOL FOR DRILL BIT SHARPENING

(76) Inventor: Gilbert M. Lea, 4108 14th St., Des Moines, IA (US) 50313

( * ) Notice: Subject to any disclaimer, the term of this patent is extended or adjusted under 35 U.S.C. 154(b) by 0 days.

(21) Appl. No.: 09/439,488

(22) Filed: Nov. 15, 1999

(51) Int. Cl.[7] ..... B24B 23/00
(52) U.S. Cl. ..... 451/344; 451/357; 269/239
(58) Field of Search ..... 451/344, 370, 451/375, 378, 380, 386, 387, 391, 404; 269/239, 157, 6, 268, 269

(56) References Cited

U.S. PATENT DOCUMENTS 2,211,393 8/1940 Travis .
2,758,430 8/1956 Sprenzel .
2,821,820 2/1958 Thumann .
3,393,476 7/1968 York .
5,241,791 9/1993 Lacy .
6,001,002 12/1999 Lea .

*Primary Examiner*—Eileen P. Morgan
*Assistant Examiner*—Hadi Shakeri
(74) *Attorney, Agent, or Firm*—Zarley, McKee, Thomte, Voorhees & Sease

(57) ABSTRACT

A hand-held trigger grip drill bit holder for drill bit sharpening includes a hand grip adapted to be held in a user's hand and a clamp on the hand grip adapted to hold a drill bit for sharpening the tip on a grinding wheel. A trigger on the hand grip moves the clamp from a normally open position to a closed position to hold the drill bit. A sight is provided on the grip to allow visual alignment of the tip of the bit for proper sharpening of the cutting edges. In one embodiment, the sight takes the form of a loop. In another embodiment, the bubble isn't intended as a sight.

12 Claims, 9 Drawing Sheets

HAND-HELD TOOL FOR DRILL BIT SHARPENING

BACKGROUND OF THE INVENTION

The cutting edges of drill bits normally become dull through use. Therefore, the cutting edges must be sharpened or the bit must be replaced. Proper sharpening of the cutting edges is important so that the bit will drill efficiently.

Numerous prior art machines exist for sharpening drill bits. Typically, the machine includes a rotatable grinding wheel, with a housing with a hole through which the bit is inserted for engagement with the grinding wheel, so as to sharpen the tip of the bit. Most of these machines are expensive and complicated. Also, such machines are relatively large in size.

Accordingly, a primary objective of the present invention is the provision of a hand-held tool for facilitating accurate sharpening of the cutting edges on the tip of a drill bit.

Another objective of the present invention is the provision of a tool for holding drill bits of various sizes to facilitate sharpening of the drill bits.

A further objective of the present invention is the provision of a hand-held drill bit-sharpening device, which permits visual alignment of the drill bit for accurate sharpening of the bit.

Another objective of the present invention is an improved method of sharpening the cutting edge of a drill bit tip using a hand-held tool and visual alignment of the bit with a grinding wheel.

These and other objectives will become apparent from the following description of the invention.

SUMMARY OF THE INVENTION

The tool of the present invention is adapted to hold various sized drill bits for sharpening on a grinding wheel or belt. The tool includes a hand grip for holding in a user's hand and a clamp on the hand grip for holding a drill bit with the tip of the bit extending slightly beyond the clamp. A trigger is provided on the hand grip and is connected to the clamp so as to move the clamp from a normally open position to a closed position for holding the drill bit. A sight is provided on the hand grip to visually align and orient the bit for sharpening on the grinding wheel. The sight is automatically adjustable to accommodate drill bits of different sizes and manually adjustable for different cutting tip angles. In one embodiment, the sight is in the form of a loop through which the user looks to orient the bit tip radially to the axis of the grinding wheel for sharpening the bit on the perimeter face of the wheel. In an alternative embodiment, the sight is in the form of a bubble level which the user can orient horizontally so that the bit tip is properly positioned on the side of the grinding wheel or a vertical face of a grinding surface.

In the method of sharpening the cutting edge of a drill bit tip using the hand-held tool of the present invention, the bit is placed in the clamp. The trigger is squeezed to close the clamp and secure the bit into position for sharpening. The user visually aligns the drill bit tip through the tool sight, the bit tip and the axis of the grinding wheel. The cutting edge of the drill bit is maintained in a horizontal orientation during sharpening, as the user looks in a direction perpendicular to the grinding surface of the grinding wheel.

DETAILED DESCRIPTION OF THE DRAWINGS

Figure 1:
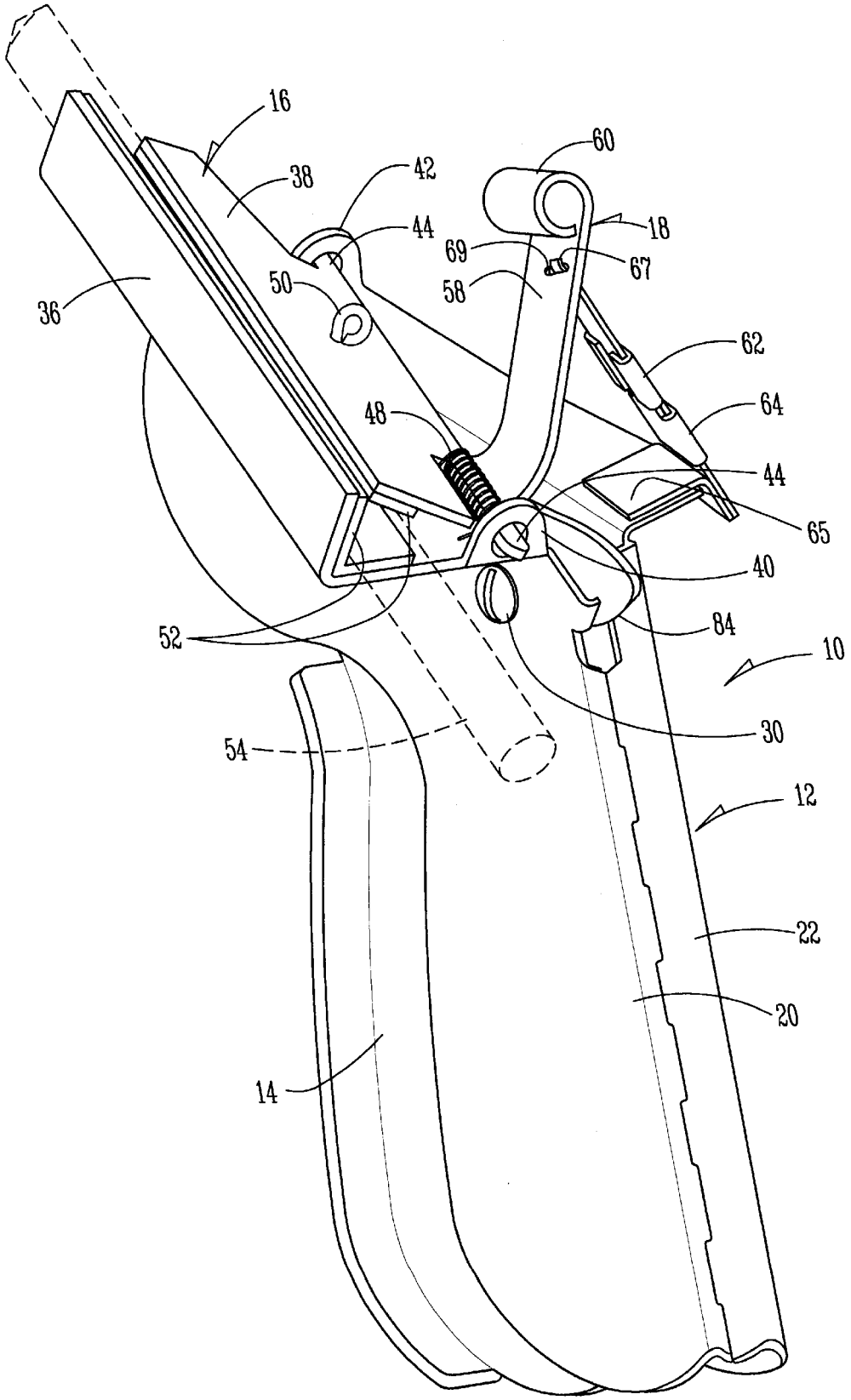
FIG. 1 is a perspective view of the first embodiment of the trigger grip drill bit sharpening tool of the present invention with a loop sight.
Figure 1A:
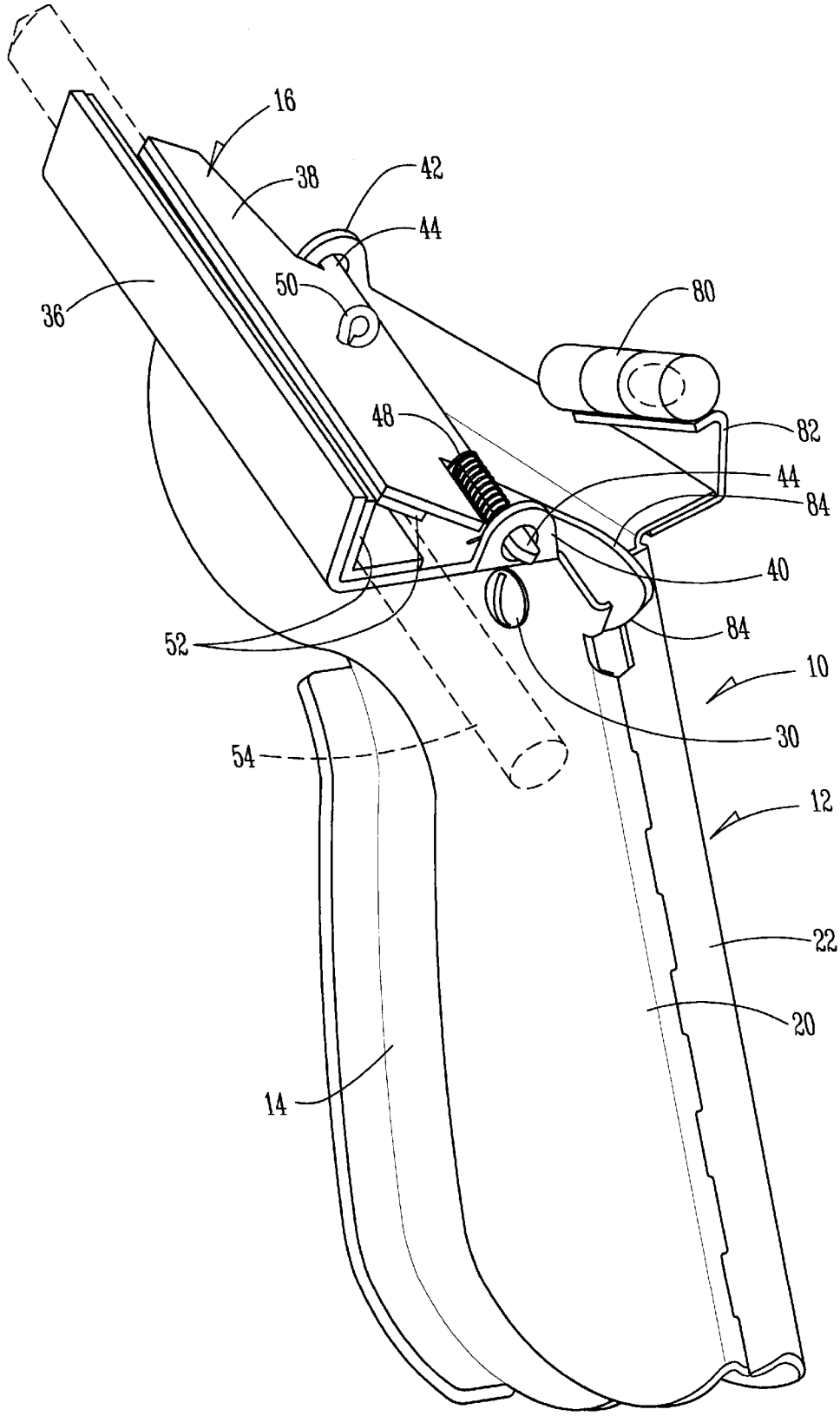
FIG. 1A is a perspective view of a second embodiment of the trigger grip drill bit sharpening tool of the present invention with a bubble level sight.
Figure 2:
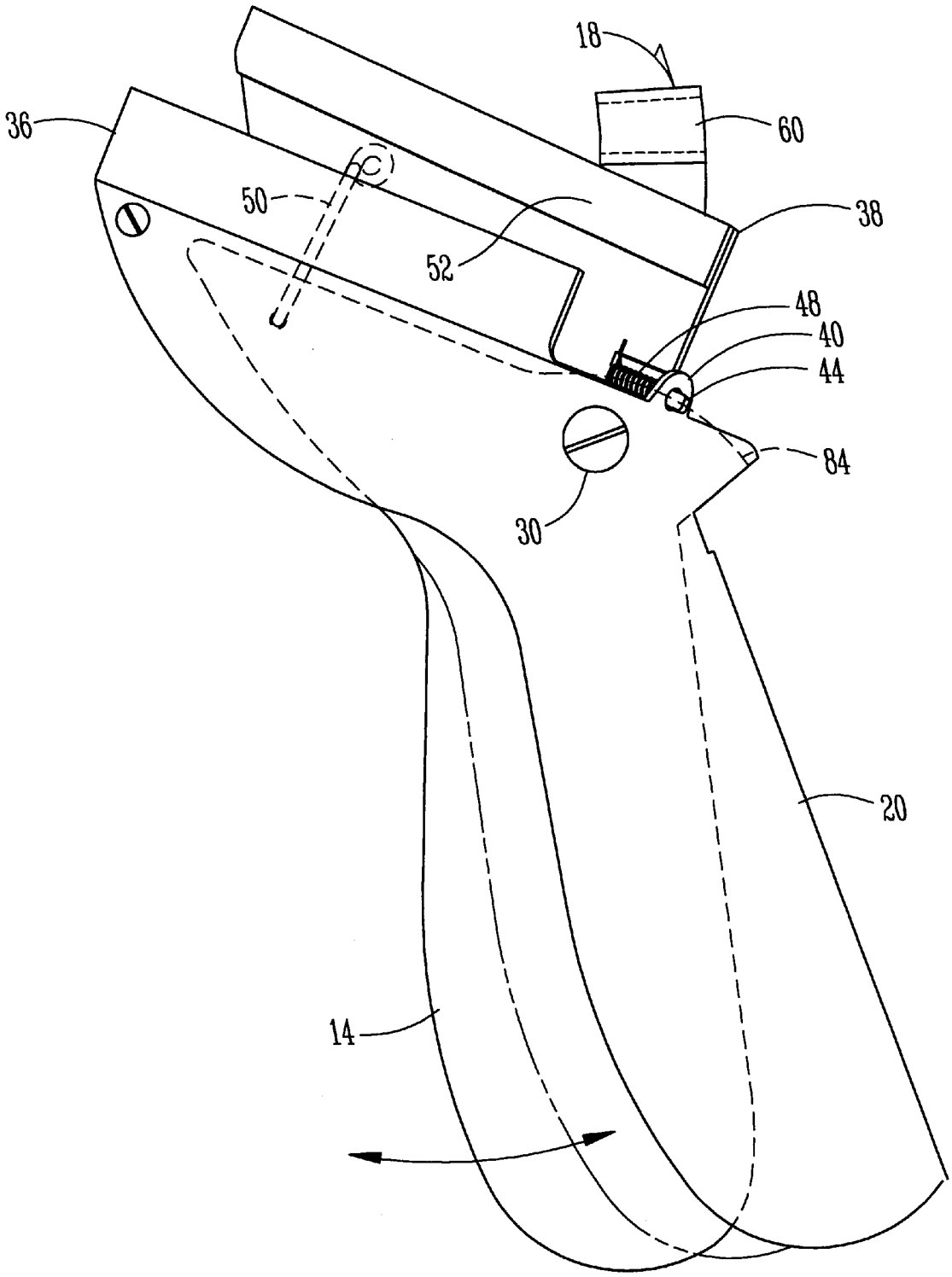
FIG. 2 is an elevation view of the first embodiment of the tool from the left side.
Figure 2A:
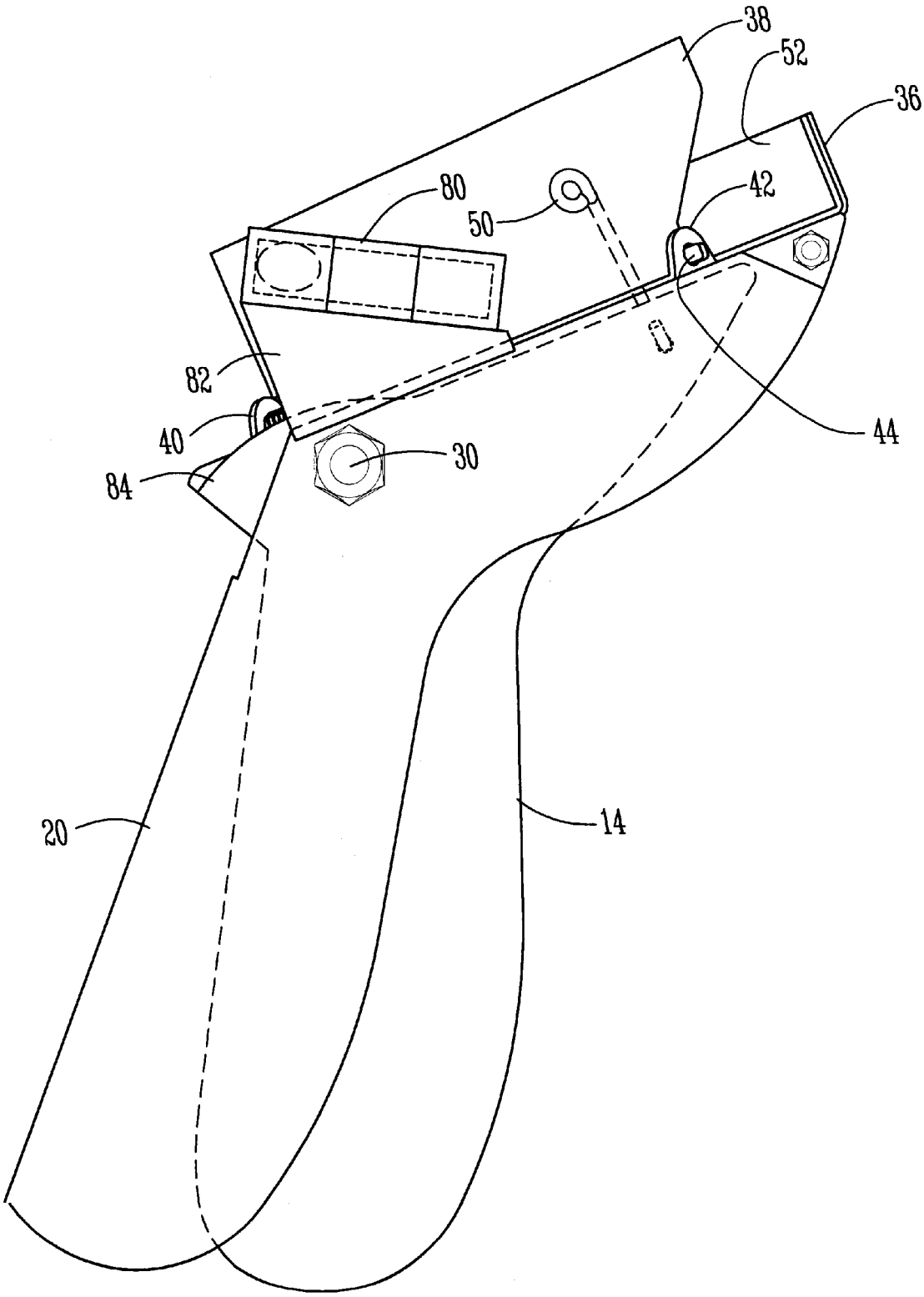
FIG. 2A is an elevation view of the second embodiment from the left side.
Figure 3:
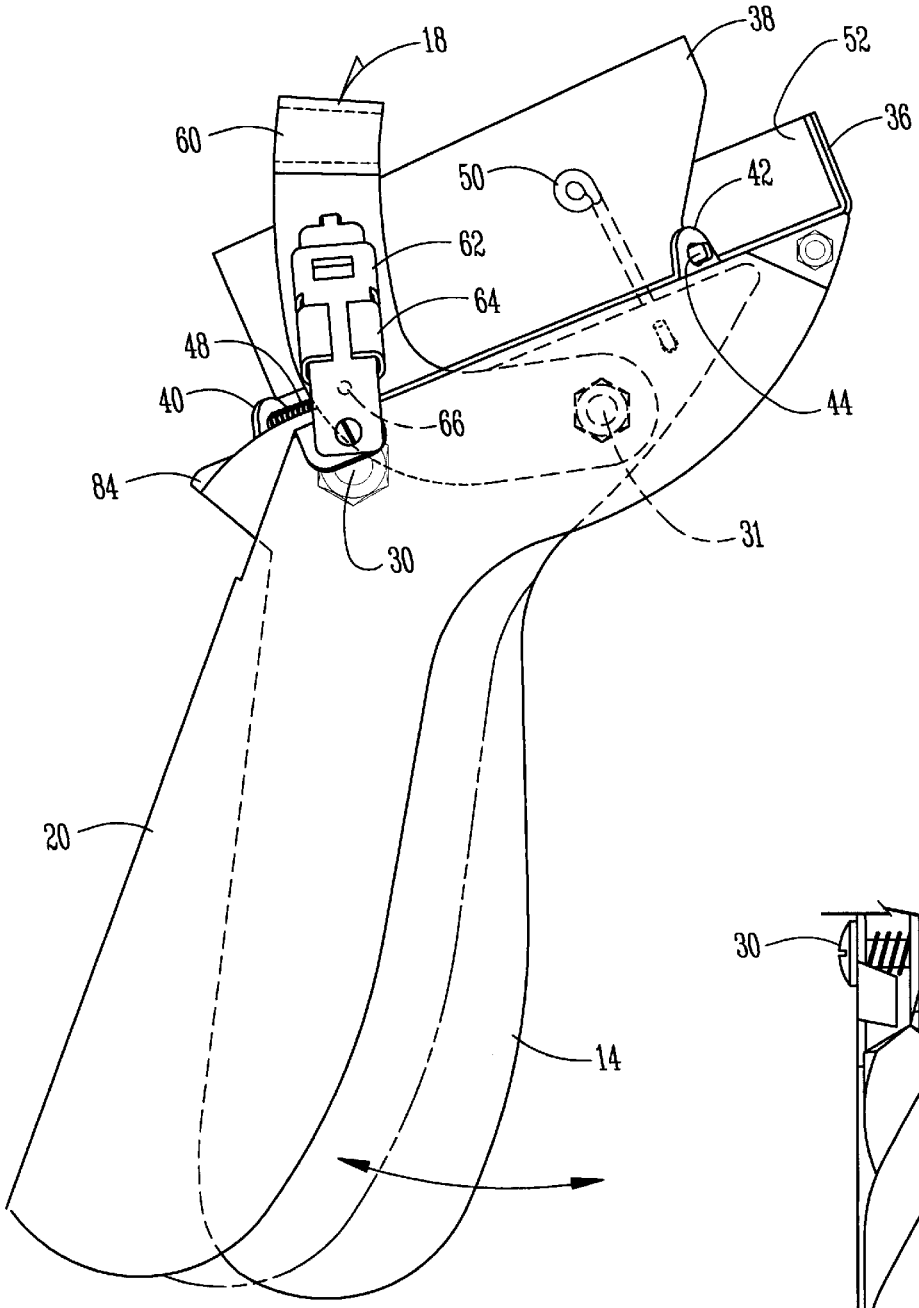
FIG. 3 is an elevation view of the first embodiment from the right side.

The trigger grip drill bit sharpening tool of the present invention is a hand-held tool and is generally designated by the reference numeral 10 in the drawings. The tool includes a hand grip 12, a trigger 14, a clamp 16, and a sight 18.

The hand grip 12 is preferably made out of two pieces 20, 22. Each piece 20, 22 of the hand grip 12 includes a plurality of fingers 24, 26 respectively, which overlap one another to join the pieces 20, 22 together. The overlapped fingers 24, 26 form a trough 28 adapted to cradle a drill bit. It is understood that the hand grip 12 can be made of one-piece construction, as opposed to the two piece construction described above.

The trigger 14 is pivotally secured to the hand grip 12 by a bolt or pin 30 extending through the left and right hand grip pieces 20, 22. The trigger is centered between the left and right hand grip pieces 20, 22 in any convenient manner. For example, a spring 32 may be provided on the bolt 30 to urge the trigger into engagement with a stop flange 34 on the right hand grip piece 22.

The clamp 16 is formed of two leaves 36, 35. The clamp leaf 36 is fixed and is formed as a bent flange on the left-hand grip piece 20. A tab 40 with an aperture is provided on the left-hand grip piece 20 and a similar tab 42 with an aperture is provided on the right hand grip piece 22. The clamp leaf 38 has outwardly extending lower ears 44, adapted to be received within the apertures of the respective tabs 40, 42, such that the clamp leaf 38 is pivotally mounted on the hand grip 12. A spring 48 normally biases the leaf 38 away from the leaf 36, such that the clamp 16 is normally in an open position. A cable or wire 50 has opposite ends connected to the trigger 14 and the clamp leaf 38. When the trigger 14 is squeezed by a user, the cable 50 pulls the leaf 38 downwardly so as to close the clamp 16.

A layer of material 52 may be glued, sprayed, or otherwise provided on the clamp leaves 36, 38 to keep a drill bit 54 positioned therebetween from rotating when positioned into the claim 16. The material 52 preferably has a coefficient of friction greater than that of the leaves 36, 38. As a further alternative, the leaves 36, 38 may be provided with serrations or teeth to facilitate the clamping of the bit 54 therebetween.

The sight 18 is provided to facilitate proper orientation of the drill bit 54 for sharpening. In the first embodiment, the sight 18 is formed by a plate 58 having a loop 60 formed at the upper end thereof. The lower end of the plate 58 is preferably connected to the trigger 14 by a bolt 31, such that as the trigger is squeezed, the loop 60 moves slightly downwardly and to the left. Thus, as the clamp 16 is closed by the trigger 14, the loop 60 of the sight 56 moves a distance corresponding to the position of the bit axis relative to the corner of the clamp leaf 36. For example, the axis of a small axis bit is closer to the clamp corner than the axis of a large bit, due to the difference in diameter of the bits. Thus, for a large bit, the loop 60 moves a small distance, whereas the loop 60 moves a larger distance with a small bit, since the trigger is pulled or squeezed further for the small bit as compared to the large bit.

The loop 60 of the sight 18 is further adjustable by telescoping members 62, 64 extending between the plate 58 and the hand grip 12. The telescoping members extend from a leaf spring 65 and are attached to the sight 18, such as by a tab 67 extending into a slot 69 on the sight 18. The leaf spring normally biases the sight 18 outwardly, or clockwise as seen in FIG. 1, to urge the clamp leaf 38 to an open position. The telescoping members 62, 64 are secured in a desired position by any convenient means, such as a detent 66. The telescoping members 62, 64 allow adjustability of the sight loop 60 so as to accommodate drill bits having different angles of the drill bit tip, typically between 118° and 135°.

Figure 8:
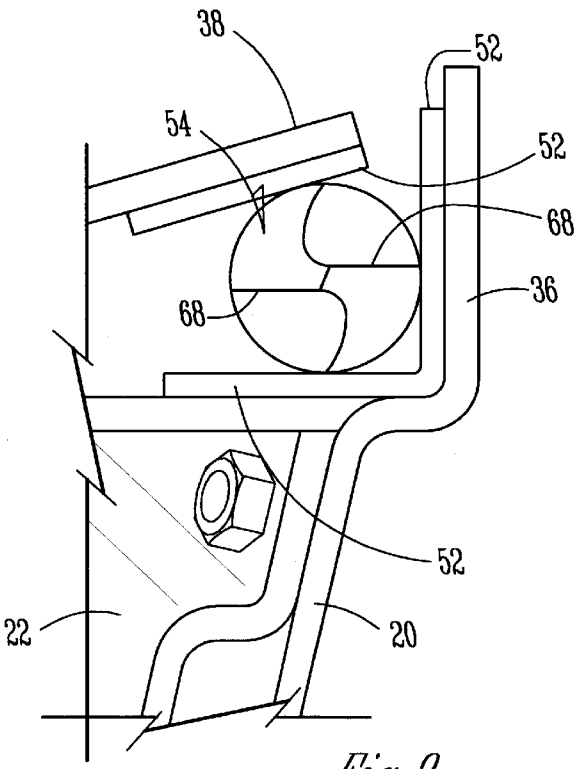
FIG. 8 is an enlarged partial front view showing the proper orientation of a drill bit in the clamp of the tool.

In using the tool 10, the drill bit 54 is inserted between the leaves 36, 38, such that the tip of the bit 54 extends a short distance beyond the front of the leaves. The cutting edges 68 of the bit 54 are oriented parallel to the fixed leaf 36, as best seen in FIG. 8. The trigger 14 is squeezed so as to close the pivotal leaf 38 against the drill bit, thereby securely holding the drill bit 54 in the clamp 16. The user then holds the tool 10 with one hand or both hands, in a manner similar to aiming a pistol, and sights through the loop 60 of the sight 56 and the tip of the drill bit 54. Thus, a line of sight 70 perpendicular to the grinding surface is established through two points, the loop 60 and the drill bit tip.

Figure 7B:
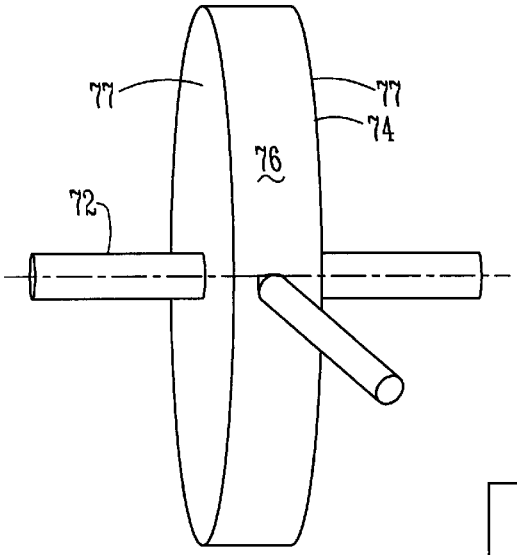
FIGS. 7A–7E are schematic views of the visual orientation of the drill bit tip relative to the grinding surface of the grinding wheel, with FIG. 7A showing proper visual alignment and FIGS. 7B–7E showing improper visual alignment, using the tool of FIGS. 1–7.
Figure 7D:
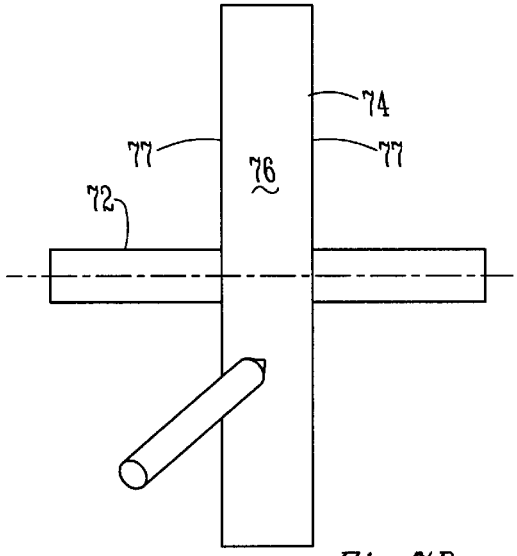
Figure 7A:
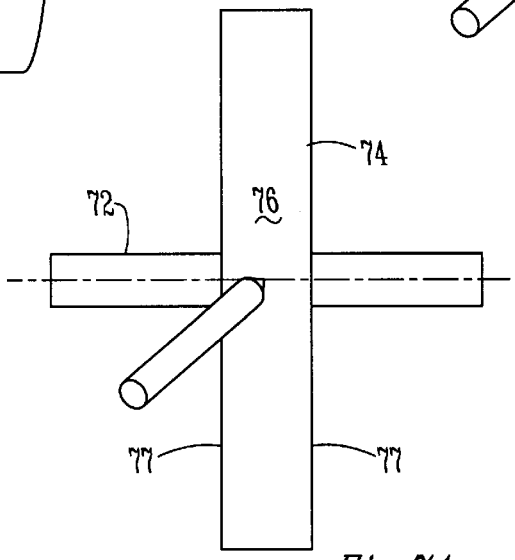
Figure 7C:
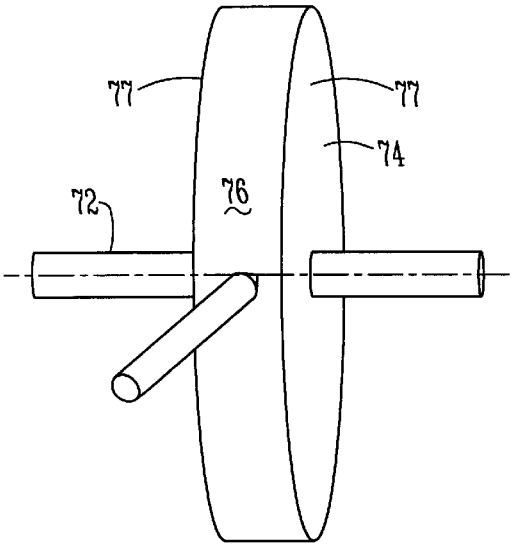
Figure 7E:
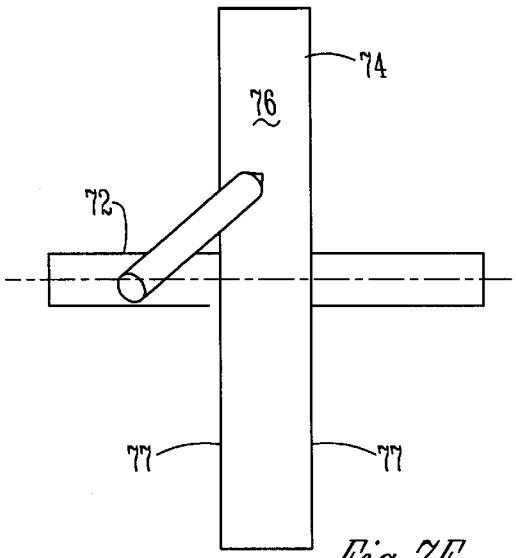

The line of sight 70 should also extend through the axis 72 of the grinding wheel 74. As seen in FIG. 7A, the user should be viewing the grinding wheel 74 squarely in a plane perpendicular to the grinding surface 76. The user's visual alignment should not be to the left or to the right of the grinding wheel 74, as shown in FIGS. 7D and 7C. Similarly, the user's visual alignment should not be below or above the grinding wheel axle 72, as shown in FIGS. 7D and 7E.

Figure 6:
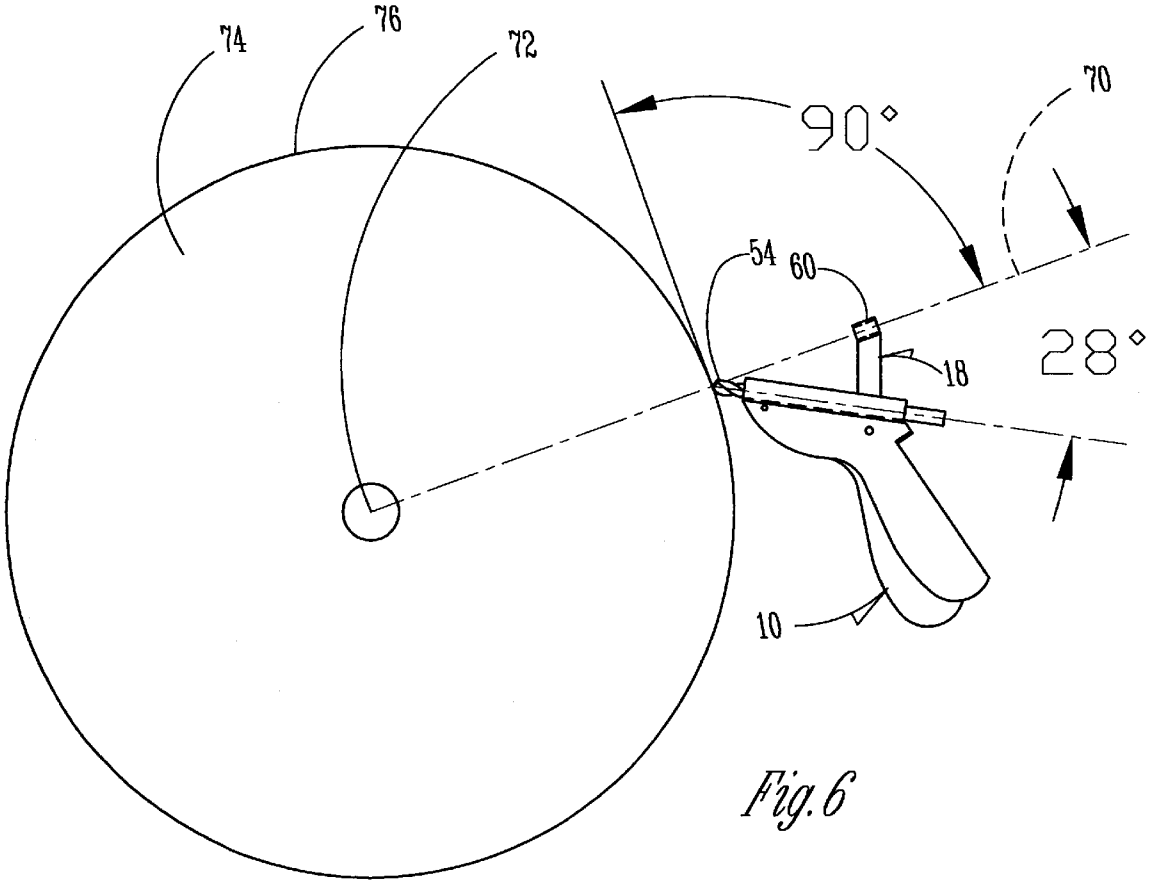
FIG. 6 is a schematic side elevation view showing proper orientation of the drill bit tip on a grinding wheel.

Also, the tool 10 should be held such that the bit 54 is oriented at an angle relative to the grinding surface 76, with the angle corresponding to the cutting angle or slope of the bit tip, as best seen in FIG. 6. When one cutting edge 68 is sharpened, hand grip 10 can be tilted slightly downwardly so as to round the heel of the tip. After the first cutting edge 68 is sharpened, the drill bit 54 can be rotated 180° in the clamp 16, such that the opposite cutting edge can be sharpened.

Thus, the user establishes an imaginary or sight line through the grinding wheel axis and perpendicular to the grinding surface 76. Preferably, the angle of the clamp 16 relative to the grip 12 offsets the axis of the bit 54 in a lateral direction to match the cutting angle of the bit 54. The user adjusts the tool 10 in a vertical direction to achieve the desired acuteness of the cutting edges 68.

In an alternative embodiment, the sight 18 takes the form of a bubble level 80. More particularly, the bubble level 80 is mounted on a support bracket 82 extending from the right grip piece 22. Preferably, the tool 10 with the bubble level 80 is used on the side 77 of the grinding wheel 74, but may also be used on any vertical grinding surface, i.e. a portion of the face or a vertical grinding belt. The bubble level 80 is disposed at an angle relative to the clamp 16 such that the orientation of the bit 54 on the grinding surface 76 of the grinding wheel 74 will be proper when the bubble level 80 is horizontal. Preferably, the bubble level 80 is offset approximately 28° with respect to the fixed clamp leaf 36.

Figure 5:
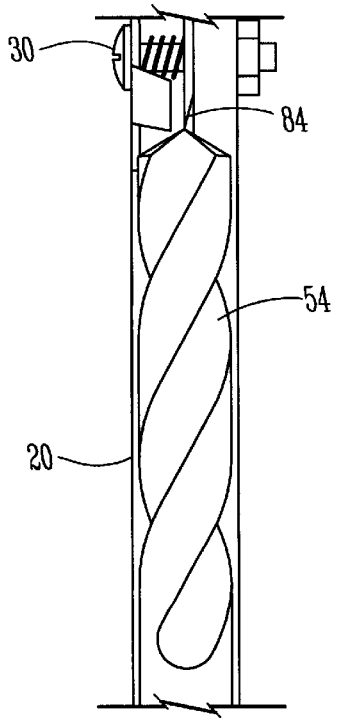
FIG. 5 is a view showing a drill bit positioned on the hand grip of the tool to check the accuracy of the sharpening
Figure 4:
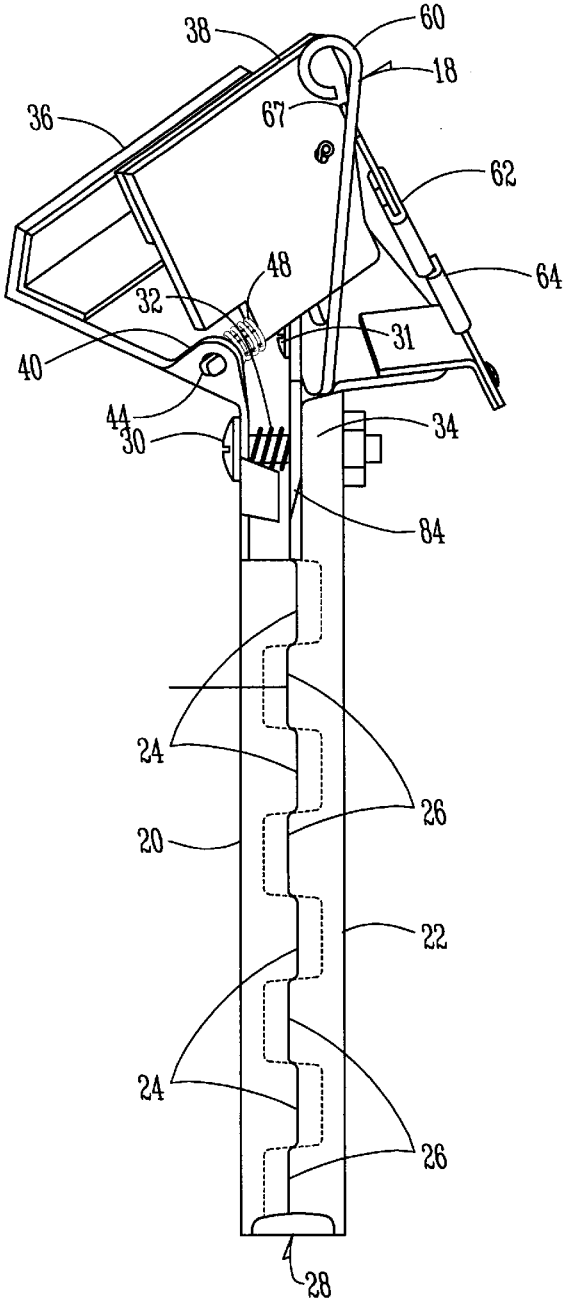
FIG. 4 is a rear end view of the first embodiment of the tool showing the telescoping members retracted.
Figure 4A:
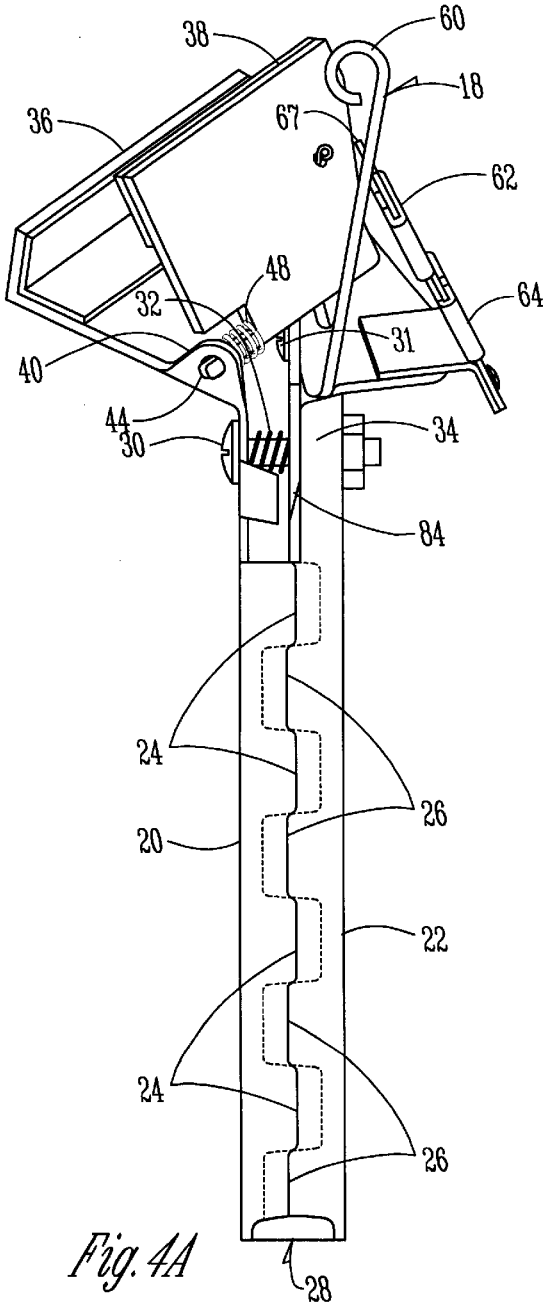
FIG. 4A is a rear end view of the first embodiment showing the telescoping members extended.

After the bit 54 is sharpened, the accuracy of the sharpening process can be checked by placing the bit in the trough 28 formed in the rearward edge of the hand grip 12. As seen in FIG. 5, if the bit 54 is properly sharpened, the point of the bit will align with a pointed extension flange 84 on the trigger 14. The extension left side of the flange 84 is axially positioned on the hand grip 12, since the trigger 14 is in the middle of the hand grip. Thus, the flange 84 is a center marker. If the point of the bit 54 does not align with the left side of the extension flange 84, additional grinding of the tip can be done for correction.

Figure 9:
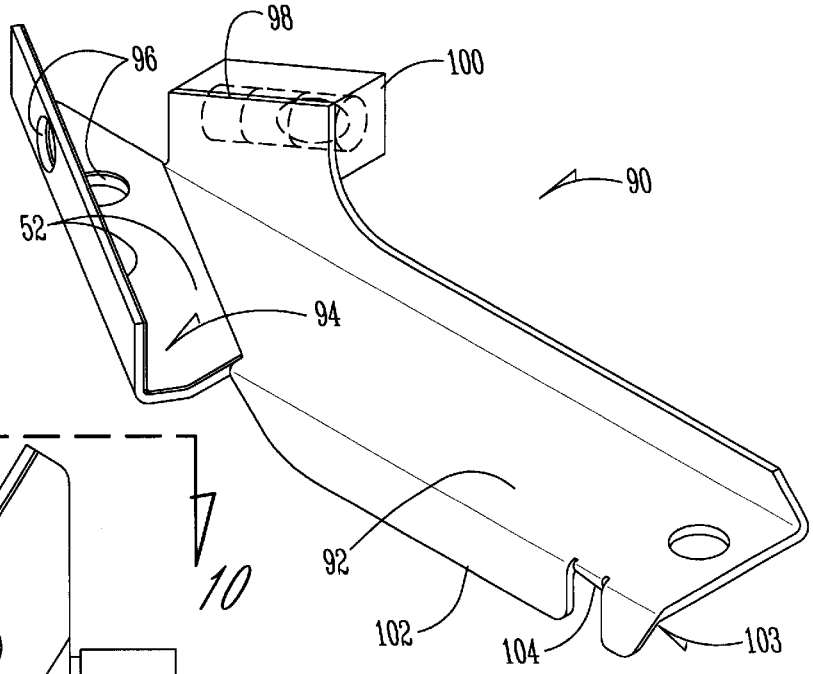
FIG. 9 is a perspective view of the third embodiment.
Figure 10:
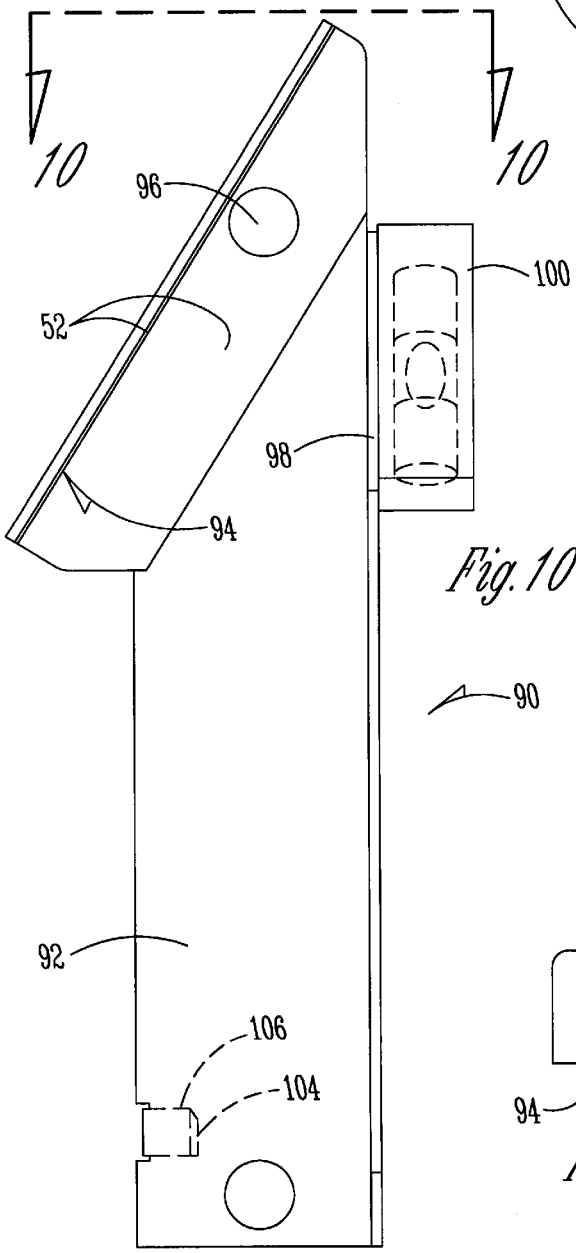
FIG. 10 is a side elevation view of the third embodiment.
Figure 11:
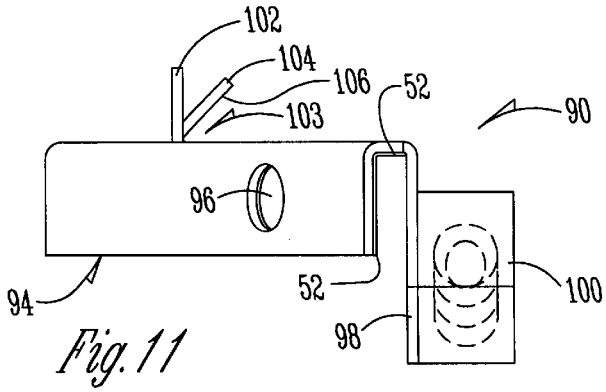
FIG. 11 is a front end view of the third embodiment.

Another embodiment is shown in FIGS. 9–11 of the drawings, wherein the drill bit sharpening tool 90 includes a hand grip 92, but no moveable clamp is provided, as in the embodiments previously described. An L-shaped bracket or cradle 94 extends from the hand grip 92 and is adapted to received a drill bit 54 which is held in place by the user's thumb. Friction material 52 is provided on the cradle 94. For small diameter drill bits, a pair of holes 96 are provided in the cradle 94 to permit the thumb to partially protrude therethrough so as to securely hold the small bit in the corner of the cradle 94. An upwardly extending leg or bracket 98 is provided on the hand grip 92 for mounting a bubble level 100, for orienting the bit 54 onto the side 77 or grinding surface 76 of the grinding wheel 74, as described above with respect to the second embodiment. The hand grip, L-shaped bracket 94 and the bubble level bracket 98 have a one-piece construction. The grip 92 has a downwardly extending leg 102 which forms a trough 103 when the tool 90 is turned 180° upside down. An inwardly bent tab 102 with a tapered leading edge 104 functions as a center point check when the bit is placed in the trough 103, similar to the tab 84 described above.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A hand held tool for holding a drill bit for sharpening comprising:

a hand grip for holding by a user;

a clamp on the hand grip for holding a drill bit with a tip to be sharpened, the clamp being normally in an open position;

a trigger pivotally mounted on a hand grip and connected to the clamp for moving the clamp to a closed position from the open position when the trigger is squeezed; and a trough on the hand grip for receiving a bit and a center marker at one end of the trough to verify proper sharpening of the bit when the bit is received in the trough.

2. The tool of claim 1 further comprising a sight on the hand grip to allow a user to visually sight a proper position for holding the drill bit on a grinder for sharpening the bit.

3. The tool of claim 2 wherein the sight is a bubble level.

4. The tool of claim 2 wherein the sight is a loop with an aperture defining a first sight point, and the bit tip defining a second sight point, the first and second sight points defining a sight line to facilitate positioning of the bit tip on a grinding wheel for sharpening.

5. The tool of claim 4 wherein the sight is variable for bits having differently angled tips.

6. A hand-held tool for holding a drill bit for sharpening comprising:

a hand grip for holding by a user;

a clamp on the hand grip for holding a drill bit with a tip to be sharpened, the clamp being normally in an open position;

a trigger pivotally mounted on the hand grip and connected to the clamp for moving the clamp to a closed position from the open position when the trigger is squeezed; and a loop with an aperature defining a first sight point and the bit tip defining a second sight point, the first and second sight points defining a sight line to facilitate positioning of the bit tip on a grinding wheel for sharpening.

7. The holder of claim 6 wherein the loop is variable for bits having differently angled tips.

8. The tool of claim 6 wherein the clamp includes a first leaf fixed to the grip and a second leaf pivotally secured to the grip, and the trigger being connected to the second leaf.

9. The tool of claim 6 wherein the hand grip includes opposing plates hinged together.

10. The tool of claim 6 wherein the hand grip includes a trough for receiving a bit and a center marker at one end of the trough to verify proper sharpening of the bit when the bit is received in the trough.

11. The tool of claim 6 wherein the grip and the clamp are angularly disposed with respect to one another.

12. The tool of claim 6 further comprising a spring on the clamp to normally bias the clamp to the open positions.

* * * * *